United States Patent [19]

Gomi et al.

[11] Patent Number: 4,919,095

[45] Date of Patent: Apr. 24, 1990

[54] DASHPOT FOR AN INTERNAL COMBUSTION ENGINE

[75] Inventors: Hideshige Gomi; Shoichi Matsumoto; Harugi Yamazaki, all of Tokyo, Japan

[73] Assignee: Fuji Jukogyo Kabushiki Kaisha, Tokyo, Japan

[21] Appl. No.: 233,023

[22] Filed: Aug. 16, 1988

[30] Foreign Application Priority Data

Sep. 7, 1987 [JP] Japan ..... 62-223580

[51] Int. Cl.[5] ..... F02B 77/00

[52] U.S. Cl. ..... 123/328; 123/DIG. 11

[58] Field of Search ..... 123/328, 493, 401, DIG. 11

[56] References Cited

U.S. PATENT DOCUMENTS

| | | | |
|---|---|---|---|
| 3,691,873 | 9/1972 | Lombard et al. | 123/328 |
| 3,753,427 | 8/1973 | Cadar | 123/328 |
| 3,760,785 | 9/1973 | Harrison et al. | 123/328 |
| 3,788,288 | 1/1974 | Harrison et al. | 123/328 |
| 4,086,900 | 5/1978 | Marsh | 123/DIG. 11 |
| 4,090,481 | 5/1978 | Gospodar | 123/DIG. 11 |
| 4,128,087 | 12/1978 | Hayashi et al. | 123/DIG. 11 |
| 4,196,704 | 4/1980 | Cook | 123/DIG. 11 |
| 4,351,296 | 9/1982 | Kayanuma | 123/328 |
| 4,391,246 | 7/1983 | Kawabata et al. | 123/328 |
| 4,463,716 | 8/1984 | Detweiler | 123/DIG. 11 |

*Primary Examiner*—Raymond A. Nelli

*Attorney, Agent, or Firm*—Martin A. Farber

[57] ABSTRACT

A dashpot has a diaphragm provided for defining a pressure chamber and an atmospheric chamber, and an actuating rod secured to the diaphragm and operatively connected to a throttle valve. A cylindrical supporting member is secured to the diaphragm, opposite to the actuating rod, and a spring loaded valve is provided on an end of the cylindrical supporting member. A pipe secured to the dashpot body and having an opening at an end thereof, is projected into the pressure chamber. The opening is disposed to be closed by the spring loaded valve when the diaphragm is deflected by the throttle valve. A solenoid operated valve is provided to communicate the pressure chamber with the atmosphere through the pipe when opened. the diaphragm and the spring loaded valve are arranged such that the spring loaded valve closes the opening of the pipe at a smaller stroke than that of the diaphragm.

8 Claims, 5 Drawing Sheets

DASHPOT FOR AN INTERNAL COMBUSTION ENGINE

BACKGROUND OF THE INVENTION

The present invention relates to a dashpot provided on a carburetor of an internal combustion engine for preventing a throttle valve thereof from closing too suddenly.

An internal combustion engine for a motor vehicle is equipped with a dashpot in order to slowly close a throttle valve. If the throttle valve is suddenly closed after the driver releases an accelerator pedal, the air-fuel mixture gets excessively rich, resulting in stalling of the engine or backfiring.

The dashpot generally comprises a body, the inner space of which is divided into an atmosphere chamber and a pressure chamber by a diaphragm, an actuating rod operatively connected to a throttle valve and attached to the diaphragm, and a spring for urging the diaphragm in a direction so as to expand the pressure chamber. As the diaphragm is displaced by the throttle valve through the rod against the urging of the spring, the air in the pressure chamber flows into the atmosphere chamber through an orifice formed in the diaphragm. Since the flow rate of the air passing through the orifice is very small, the movement of the diaphragm is dampened, thereby slowly closing the throttle valve.

However, such a dashpot has only a simple operational mode so that it cannot cope with various decelerating conditions of the vehicle.

Publications of Japanese Utility Model Laid Open 55-35356 and 55-167552 disclose a throttle-return check device comprising two dashpots, having different operational strokes, disposed in tandem. One of the dashpots is selected dependent on the vacuum in the intake manifold downstream of the throttle valve. Accordingly, the device provides different dampening effects for different decelerating conditions.

However, since such a device comprises two dashpots, the number of the components thereof increases and hence the control system becomes complicated, increasing its manufacturing cost.

SUMMARY OF THE INVENTION

The object of the present invention is to provide a dashpot having different throttle valve closing characteristics, one of which can be selected with a relatively simple device so as to appropriately close the throttle valve in accordance with driving conditions of a motor vehicle.

According to the present invention, there is provided a dashpot for an internal combustion engine hving an actuating means such as a throttle valve, the dashpot having a dashpot body, a diaphragm provided in the dashpot body for defining a pressure chamber and an atmospheric chamber and having an orifice therein, a first spring in a neutral condition biasing the diaphragm to a predetermined position and an actuating rod secured to the diaphragm extending opposite to the pressure chamber and operatively connected to the throttle valve at the other end when the throttle valve is closed.

The dashpot comprises a supporting member secured to the diaphragm, opposite to the actuating rod, disposed in the pressure chamber, a spring loaded valve mounted on the supporting member, a second spring for biasing the spring loaded valve at a projected position, a pipe secured to the dashpot body and having an opening at an end thereof facing the spring loaded valve, disposed in the pressure chamber, the opening being closed by the spring loaded valve when the diaphragm is deflected by the throttle valve and a solenoid operated valve arranged to communicate the pressure chamber with atmosphere through the pipe when opened.

The diaphragm and the spring loaded valve are arranged such that the spring loaded valve closes the opening of the pipe at a smaller stroke than that of the diaphragm.

The other objects and features of this invention will become understood from the following description with reference to the accompanying drawings.

DETAILED DESCRIPTION OF THE PREFERRED EMBODIMENT

Figure 1A:
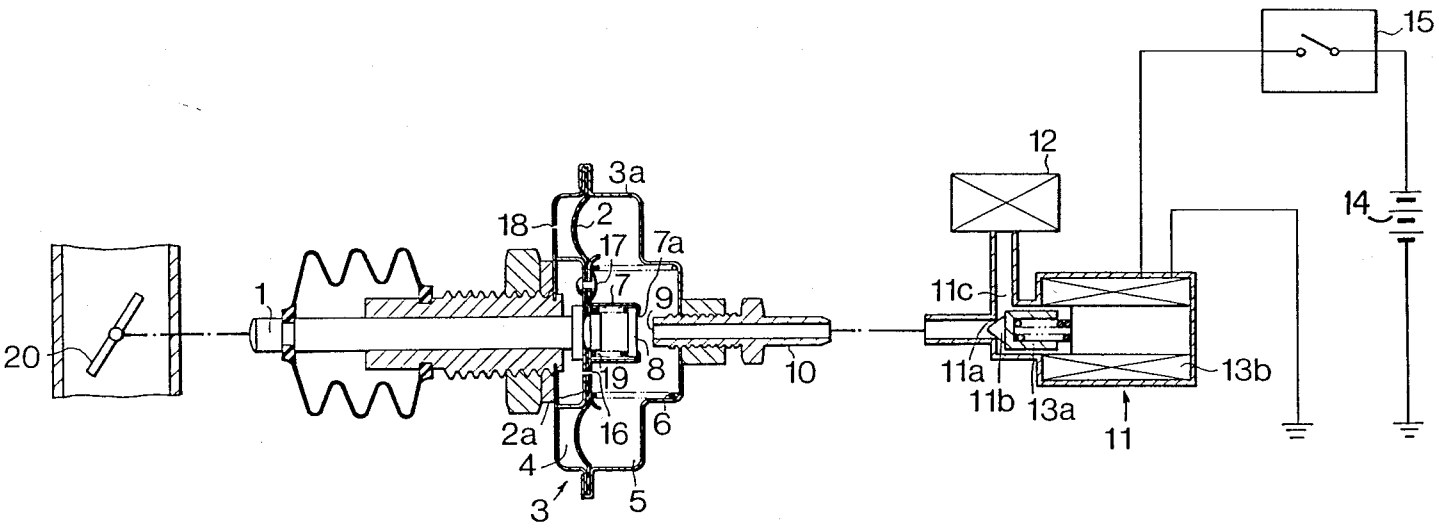
FIGS. 1*a* and 1*b* are schematic sectional side views respectively showing a system of the present invention in different operating states.
Figure 1B:
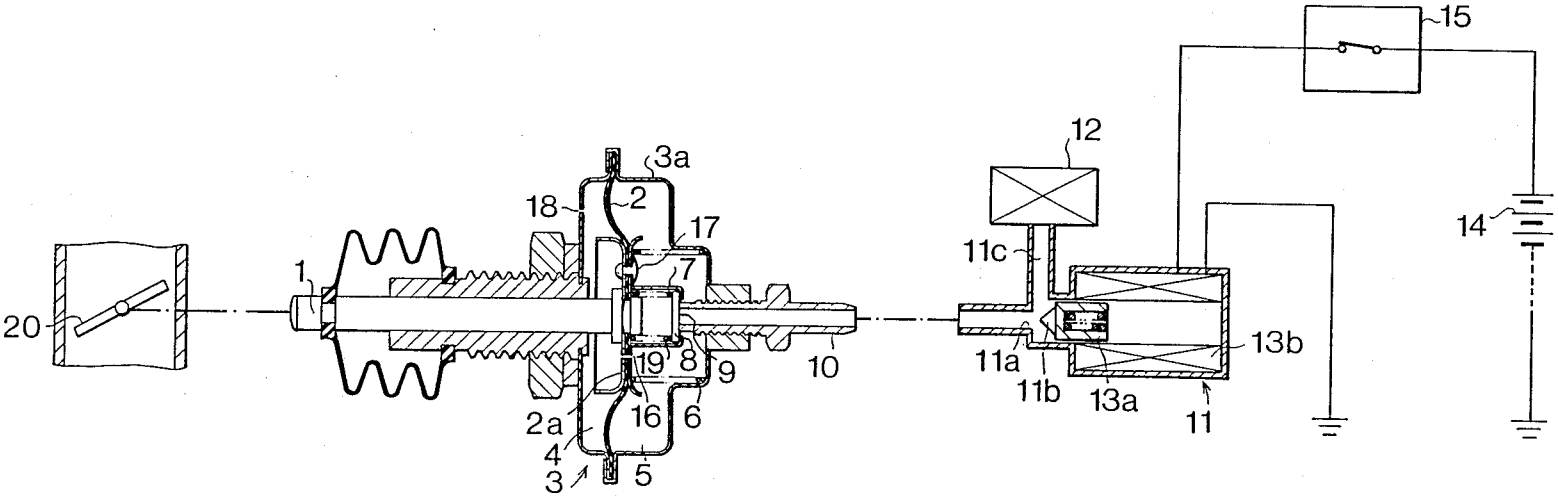

Referring to FIGS. 1*a* and 1*b*, a dashpot 3 of the present invention comprises a dashpot body 3*a*, a diaphragm 2 defining an atmosphere chamber 4 and a pressure chamber 5 in the body 3*a*, and an actuating rod 1 connected to the diaphragm 2 at the side opposite to the pressure chamber 5 and operatively connected to a throttle valve 20 of an engine at closing of the throttle valve. A coil spring 6 is provided in the pressure chamber 5 for urging the diaphragm 2 toward the atmosphere chamber 4. A cylindrical valve supporting member 7 is mounted on the diaphragm 2 at the side opposite to the rod 1, projecting in the pressure chamber 5. An opening 7*a* is formed in the projected side (the free end) of the member 7. A circular valve 8 which is disposed in the supporting member 7 is urged toward the flanged periphery of opening 7*a* by a spring 19 having a lighter load than the spring 6. A center portion 2*a* of the diaphragm 2 has an orifice 16 communicating the chambers 4 and 5 with each other, and a check valve 17 for introducing air into the chamber 5 through the atmosphere chamber 4. An opening 18 is formed in the body 3*a* communicating the chamber 4 with the atmosphere. A pipe 10 communicating the chamber 5 with a solenoid operated valve 11 is provided such that an opening 9 thereof faces the circular valve 8.

The solenoid operated valve 11 comprises a valve chamber 11*c*, a valve seat 11*a* formed in the chamber 11*c*, a plunger 13*a* having a conical valve body 11*b* removably seated in the valve seat 11*a*, and a solenoid 13*b*. The solenoid 13*b* is connected to a battery 14 through a switch 15. When the switch 15 is closed as shown in FIG. 1*b*, the solenoid 13*b* is energized so as to shift the plunger 13*a* to the right. Accordingly, the valve body 11*b* leaves the valve seat 11*a*, thereby communicating the pipe 10 with the atmosphere through a filter 12.

The operation of the system of present invention will be described hereinafter. Referring to FIG. 1*a*, when the switch 15 is opened, the solenoid 13*b* is de-energized so that the solenoid operated valve 11 is closed. Accordingly, the pressure chamber 5 of the dashpot 3 does not communicate with the atmosphere except by communication through the orifice 16.

Figure 2:
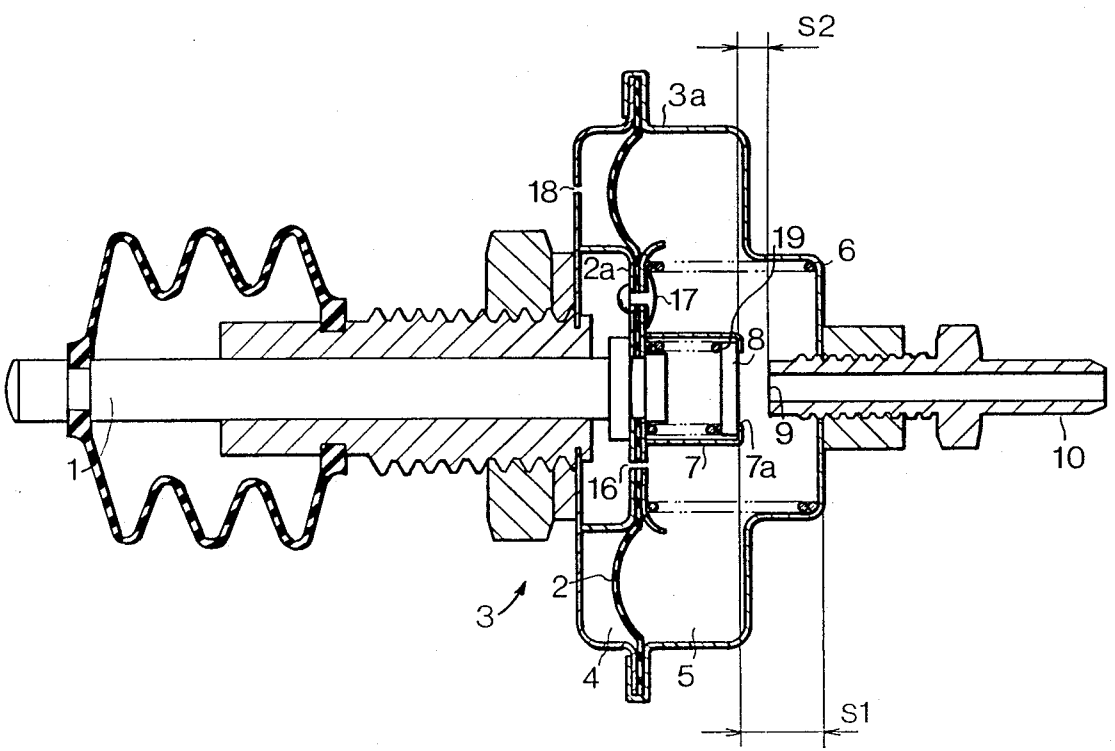
FIGS. 2 to 4 are sectional views of a dashpot of the present invention explaining the operation thereof.
Figure 3:
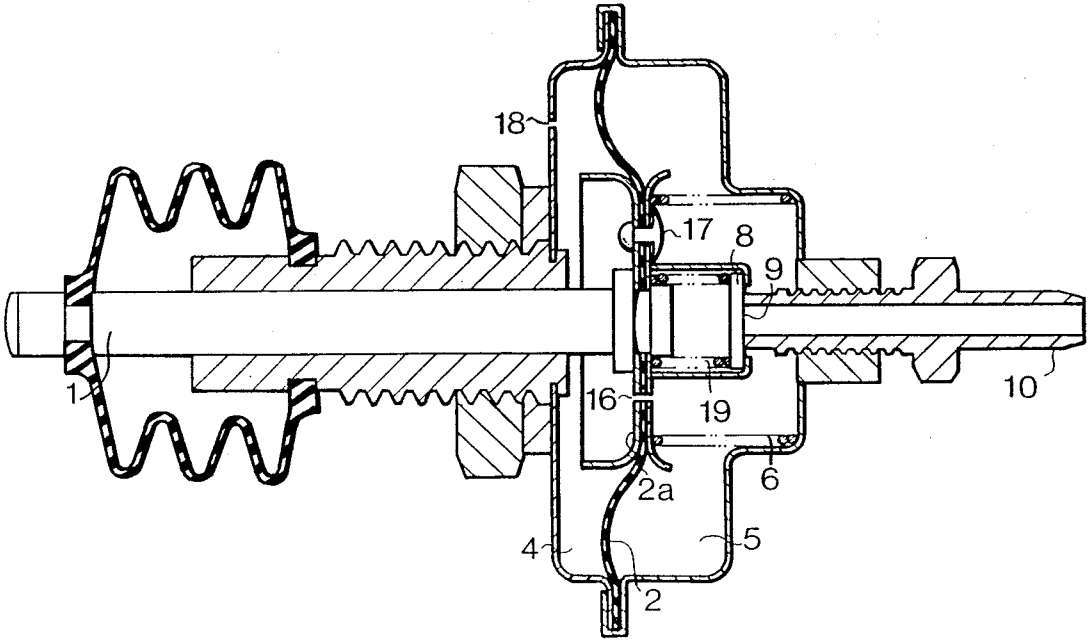
Figure 4:
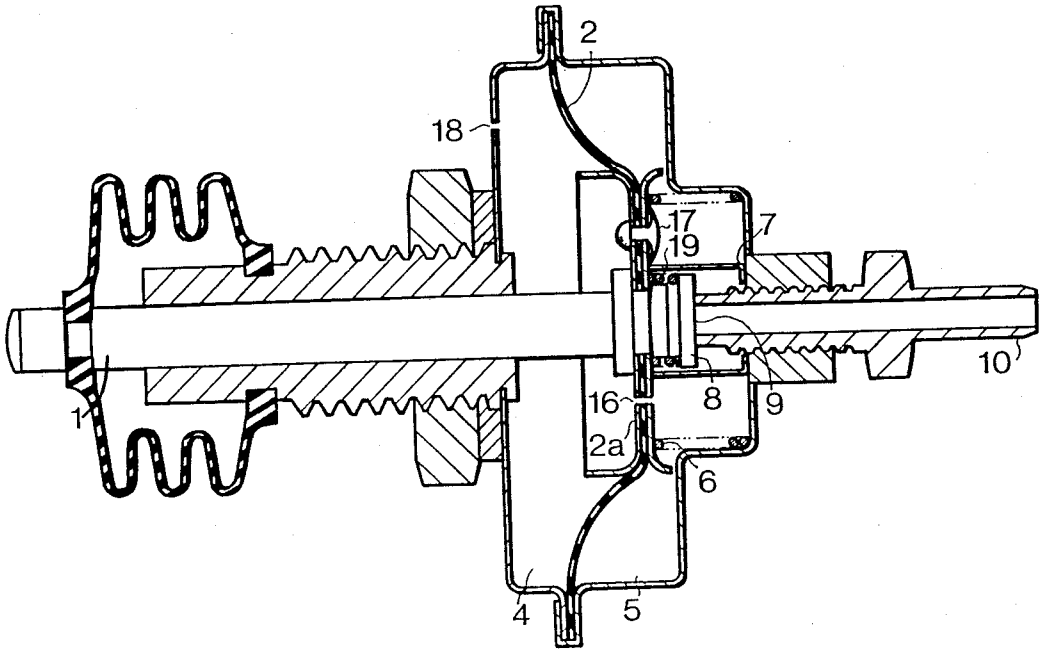

When the throttle valve 20 is opened, the throttle valve is disconnected from the actuating rod 1. Thus, no load is exerted on the actuating rod 1. The diaphragm 2 is urged by the spring 6 toward the atmosphere chamber 4 as shown in FIG. 2. When the accelerator pedal is released, the load of the throttle valve is exerted on the rod 1. Since the switch 15 is opened, the solenoid operated valve 11 is closed. Accordingly, the pressure in the pressure chamber 5 rises. Thus, the diaphragm 2 is slowly deflected toward the chamber 5 by the rod 1 as the air in the chamber 5 flows into the atmosphere chamber 4 little by little through the orifice 16. Accordingly, the valve 8 is shifted along with the valve supporting member 7 to abut against the pipe 10 as shown in FIG. 3, thereby closing the opening 9. As the throttle valve is further closed, the diaphragm 2, urged by the actuating rod 1, pushes the supporting member 7 toward the pipe 10. The pipe 10 is inserted in the supporting member 7 through the opening 7*a* against the spring 19 until the supporting member 7 abuts against the wall of the chamber 5, as shown in FIG. 4. Thus, the movement of the rod 1 is dampened so that the throttle valve is prevented from closing too suddenly during an entire stroke S1 (FIG. 2).

When the switch 15 is closed as shown in FIG. 1*b*, the solenoid 13*b* is energized so as to shift the plunger 13*a* and the valve body 11*b* to open the valve 11. Accordingly, when the dashpot 3 and throttle valve 20 are in the position as shown in FIG. 1*a*, the pressure chamber 5 is communicated with the atmosphere through the pipe 10 and filter 12. Thus, as the throttle valve closes, the rod 1 is easily pushed into the body 3*a* without any resistance during the first part S2 of the stroke S1, which corresponds to the operation from the state shown in FIG. 2 to the state shown in FIG. 3. At the position of FIG. 3, the opening 9 of the pipe 10 is closed by the valve 8 so that the pressure chamber 5 is no longer communicated with the atmosphere through the solenoid operated valve 11, resulting in an increase of the pressure therein. Accordingly, during the latter part of the stroke (S1–S2), where the supporting member 7 is moved from the position shown in FIG. 3 to the position in FIG. 4, the movement thereof is dampened, thereby slowly closing the throttle valve as described above.

Therefore, the dashpot 3 of the present invention has two damping modes consisting of a long stroke and a short stroke. The mode can be selected in accordance with driving conditions. For example, during the driving of the vehicle, the long stroke mode is selected, and when the vehicle is stopped, the short stroke mode is selected.

In accordance with the present invention, there is provided a compact and inexpensive dashpot having a plurality of damping modes with a simple construction.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A dashpot for an internal combustion engine having a throttle valve, the dashpot having a dashpot body, a diaphragm provided in the dashpot body for defining a pressure chamber and an atmospheric chamber and having an orifice therein, a first spring in a neutral condition biasing the diaphragm to a predetermined position, an actuating rod secured to the diaphragm at an end of the rod and extending opposite to the pressure chamber and operatively connected to the throttle valve at the other end when the throttle valve is closed, comprising:

a supporting member secured to the diaphragm opposite to the actuating rod, disposed in the pressure chamber;

a spring loaded valve mounted on the supporting member;

a second spring for biasing the spring loaded valve toward a projected position;

a pipe secured to the dashpot body and having an opening at an end thereof, disposed in the pressure chamber, the opening being disposed to be closed by the spring loaded valve when the diaphragm is deflected by the throttle valve;

a solenoid operated valve arranged to communicate the pressure chamber with the atmosphere through the pipe when opened; and the diaphragm and the spring loaded valve being arranged such that the spring loaded valve closes the opening of the pipe at a smaller stroke than that of the diaphragm.

2. The dashpot according to claim 1 wherein the supporting member is a cylindrical member projecting in the pressure chamber and the spring loaded valve is displaceably mounted at a projected portion thereof.

3. The dashpot according to claim 2 wherein the second spring is disclosed in the cylindrical member.

4. A dashpot system for controlling a damping movement of actuating means mounted on an internal combustion engine, said actuating means for controlling said engine, the dashpot system comprising a dashpot comprising a dashpot body, a diaphragm provided in said dashpot body to separate a pressure chamber and an atmospheric chamber, an orifice formed in said diaphragm commmunicating said pressure and atmospheric chambers, a first spring in said pressure chamber for biasing said diaphragm, a pipe, a solenoid-valve communicating with said pressure chamber via said pipe, the solenoid-valve arranged so as to have selective conditions of opening to, and closing from, respectively, atmospheric pressure, an actuating rod operatively disposed between said diaphragm and said actuating means so as to displace said diaphragm in a direction toward said pressure chamber against the biasing of said spring when said actuating means is released, the dashpot further comprising a supporting member secured to said diaphragm in said pressure chamber, said pipe has an opening end which projects into said pressure chamber, a valve mounted in said supporting member so as to open said opening end of said pipe when said valve is spaced apart from said opening end of said pipe and to close said opening end of said pipe when said valve abuts said opening end of said pipe, respectively, depending on displacement position of said diaphragm;

a second spring disposed between said diaphragm and said valve biasing said valve toward said opening end of said pipe, whereby a short stroke of damping movement occurs when said actuating means is released and said solenoid-valve is opened to said atmospheric pressure, and whereby a long stroke of damping movement occurs when said actuating means is released and said solenoid-valve is closed from said atmospheric pressure.

5. The dashpot according to claim 4, wherein said solenoid-valve is opened to said atmospheric pressure and closes therefrom, respectively, depending on driving conditions.

6. The dashpot according to claim 5, wherein said solenoid-valve is opened to the atmospheric pressure when the vehicle is stopped and closes therefrom during driving of the vehicle.

7. The dashpot according to claim 4, wherein said second spring has a lighter load than that of said first spring.

8. The dashpot according to claim 4, wherein said actuating means is a throttle valve.

* * * * *